United States Patent [19]

Clarke

[11] 4,298,481

[45] Nov. 3, 1981

[54] HIGH TEMPERATURE GREASE COMPOSITIONS

[75] Inventor: David B. Clarke, Annandale, N.J.

[73] Assignee: Tenneco Chemicals, Inc., Saddle Brook, N.J.

[21] Appl. No.: 15,533

[22] Filed: Feb. 23, 1979

[51] Int. Cl.[3] ..... C10M 7/24

[52] U.S. Cl. ..... 252/21; 252/28; 252/32.7 E; 252/33; 252/56 S

[58] Field of Search ..... 252/21, 28, 32.7 E, 252/33, 56 S

[56] References Cited

U.S. PATENT DOCUMENTS

| | | | |
|---|---|---|---|
| 2,930,758 | 3/1960 | Tierney et al. | 252/56 S UX |
| 3,429,817 | 2/1969 | Furey et al. | 252/56 S |
| 3,655,559 | 4/1972 | Holt | 252/56 S X |
| 3,697,427 | 10/1972 | Byford et al. | 252/56 S X |
| 3,790,481 | 2/1974 | Byford et al. | 252/56 S X |
| 3,833,513 | 9/1974 | Fath | 252/56 S X |
| 3,850,682 | 11/1974 | Sturwold et al. | 252/56 S X |
| 3,850,824 | 11/1974 | Nebzydoski et al. | 252/56 S X |
| 4,036,771 | 7/1977 | Denis et al. | 252/56 S X |
| 4,049,563 | 9/1977 | Burrous | 252/56 S X |
| 4,124,514 | 11/1978 | Yaffe | 252/56 S X |
| 4,141,844 | 2/1979 | Yaffe | 252/56 S X |

*Primary Examiner*—Arthur P. Demers
*Attorney, Agent, or Firm*—Evelyn Berlow

[57] ABSTRACT

High temperature grease compositions comprise 80% to 94% by weight of a base fluid that is a dialkyl ester of hydrogenated dimer acids that contain less than 8% by weight of trimer acids, 0.2% to 6% by weight of an additive system that contains antioxidant, rust-inhibiting, metal-passivating, and load-bearing components, and 5% to 20% by weight of a thickener component that comprises an oleophilic surface-modified clay and a dispersant.

12 Claims, No Drawings

HIGH TEMPERATURE GREASE COMPOSITIONS

This invention relates to ester-based greases that have good thermal stability and that retain their lubricity when subjected to elevated temperatures for prolonger periods of time.

With the development of high speed aircraft and aerospace vehicles, the requirement that grease compositions provide good lubrication at high temperatures for extended periods of time has become increasingly important. A number of grease compositions have been developed to meet these requirements, but all have shortcomings that limit their use in these high temperature applications. Greases formulated from diesters derived from dicarboxylic acids having 6 to 12 carbon atoms, such as di(2-ethylhexyl) sebacate and di(tridecyl) adipate, perform well at temperatures up to about 150° C., but at the higher temperatures now required by military and commercial specifications they are too volatile to retain their effectiveness for long periods of time and they tend to break down to form sludges and deposits that interfere with the lubricating function. Silicone-based greases are stable at temperatures as high as 240° C., but the lubricity of these high temperatures greases is unsatisfactory and their cost is very high.

It is known in the art that dimerized fatty acids and esters of these acids can be used as the base fluids of lubricating compositions. For example, U.S. Pat. No. 2,930,758 discloses the use of aliphatic diesters of the dimer of linoleic acid in combination with certain antioxidants and antiwear agents in lubricant compositions. In U.S. Pats. No. 3,429,817 and No. 3,850,682, glycol esters of dimer acids are used as the base fluid in lubricant compositions. In addition, lubricant compositions that contain a major portion of a hydrocarbon oil and a minor amount of an ester of dimer acids are disclosed in U.S. Pat. Nos. 4,036,771 and No. 4,049,562. While all of the disclosed lubricating compositions have good lubricating properties, none has the combination of excellent antifriction and antiwear properties, oxidative stability and thermal stability, low volatility, and other properties that are required of greases that are to be used for long periods of time at temperatures above 200° C. under heavy load conditions.

In accordance with this invention, a high temperature grease is provided that comprises a base fluid that is a $C_{5-16}$ dialkyl ester of hydrogenated dimer acids that contain less than 8% by weight of trimer acids, an additive system and hereinafter defined, and a thickening component that comprises an oleophilic surface-modified clay. These grease compositions are characterized by excellent lubricity and wear characteristics, good extreme pressure properties, excellent thermal and oxidative stability, and low volatility at temperatures above 200° C.

The base fluids of the high temperatures greases of this invention are dialkyl dimerates that are derived from alkanols having 5 to 16 carbon atoms, preferably 10 to 13 carbon atoms, and hydrogenated dimer acids. The useful hydrogenated dimer acids, which have 32 to 52 carbon atoms, are aliphatic dicarboxylic acids that are formed by hydrogenating the unsaturated dicarboxylic acids obtained by the dimerization of unsaturated fatty acids having from 16 to 26 carbon atoms or their ester derivatives. The polymerization of fatty acids to form the dimer acids and the hydrogenation of dimer acids have been described extensively and need not be amplified here. The preferred hydrogenated dimer acids for use in the preparation of the base fluids are those having 36 carbon atoms, such as the hydrogenated dimers of oleic acid, linoleic acid, and eleostearic acid. To form greases that have the desired physical properties, the hydrogenated dimer acid used in the preparation of the base fluids should contain not more than 8% by weight and preferably 5% by weight or less trimer acids. Suitable hydrogenated dimerized fatty acids are sold under the tradkmark Hystrene by Humko-Sheffield Inc. and the trademark Empol by Emery Industries.

The high temperature greases of this invention are formed by blending a base fluid that is a dialkyl ester of hydrogenated dimer acids with an additive system that contains a number of components, each of which is used to impart a particular characteristic to the grease, and a thickener component. Generally, an additive system that consists of antioxidant, rust-inhibiting, metal-passivating, and loadbearing components is dissolved in the base fluid, and a thickener component that comprises an organophilic clay and a dispersant is used to convert the resulting solution to a grease.

The grease compositions of this invention contain from 80% to 94% by weight of the base fluid, 0.2% to 6% by weight of the additive system, and 5% to 20% by weight of the thickener component. They preferably contain from 85% to 90% by weight of the base fluid, 0.7% to 4% by weight of the additive system, and 8% to 12% by weight of the thickener component.

The additive systems that are dissolved in the base fluids to form solutions that on thickening become the greases of this invention contain from 0.1% to 2% of an antioxidant component, 0.08% to 2% of a rust-inhibiting component, 0.01% to 1% of a metal-passivating component, and 0.01% of a load-bearing component all percentages being percentages by weight based on the weight of the grease composition. The additive systems preferably contain 0.5% to 1.5% of an antioxidant component, 0.1% to 1% of a rust-inhibiting component, 0.02% to 0.5% of a metal-passivating component, and 0.05% to 0.5% of a load-bearing component, all percentages by weight based on the weight of the grease composition. Each of these components may consist of a single compound or a mixture of two or more compounds.

The antioxidant component of the additive system contains at least one aromatic amine antioxidant alone or in combination with a hindered phenol, organic phosphite, alkyl thiodialkanoate, and/or other conventional antioxidant. Suitable aromatic amine antioxidants include secondary amines having the structural formula $$R'-\overset{\overset{\displaystyle H}{|}}{N}-R''$$

wherein R′ and R″ are each phenyl, alkylphenyl, naphthyl, or alylnaphthyl; phenothiazine and substituted phenothiazines; and alkyl-hydroxybenzylcarbazoles. Illustrative of these compounds are N-phenyl-α-naphthylamine, diphenylamine, dinaphthylamine, ditolylamine, phenyltolylamine, p,p′-dioctyldiphenylamine, p,p′-dinonyldinaphthylamine, tolylnaphthylamine, diphenyl p-phenylene diamine, octylphenyl-α-naphthylamine, p-aminodiphenylamine, dodecylaniline, phenothiazine, N-methylphenothiazine 3,7-dimethylphenothiazine, N-methyl-3,4-dioctylphenothiazine, N-benzyl-3,7-diisopropoxyphenothiazine, N-cyanobutyl-3,7-dioctylphenothiazine, N-n-octyl-3,7-dibutylphenothiazine, 9(3,5-di-tert.butyl-4-hydroxybenzyl)-carbazole, 3,6-bis(3,5-di-tert.butyl-4-hydroxybenzyl)carbazole, and mixtures thereof.

Among the rust inhibitors that may be present in the additive systems are Group II metal salts, ammonium salts, and amine salts of petroleum sulfonic acids alkylates naphthalene sulfonic acids, and alkenylsuccinic acids as well as $C_{10-18}$ fatty acids esters of sorbitan. The preferred rust inhibitor is sorbitan monooleate.

Metal passivators are used to reduce the corrosion of engine component materials, such as copper and lead, when they are exposed to the greases for long periods at high temperatures and in the presence of air. Among the most effective of the copper passivators are compounds of the azole type, such as imidazole, pyrazole, triazole, and their derivatives including benzimidazole; benzotriazole, substituted benzotriazoles such as methylbenzotriazole, dodecylbenzotriazole, and 3-amino-5-anilido-1,2,4-triazole, and benzotriazole derivatives such as methylene bis benzotriazole and reaction products of benzotriazole with $C_{12-18}$ secondary amines and formaldehyde; phenothiazine; napthotriazole; salicylaldehyde semicarbazone and its alkyl derivatives such as isopropyl salicylaldehyde semicarbazone; condensation products of salicylaldehyde with hydrazine derivatives and the $C_{12-18}$ fatty acids salts of such condensation products, e.g. the palmitic acid or oleic acid salt of salicylalaminoguanidine; and mixtures thereof. The preferred copper passivators are benzotriazole, the reaction products of benzotriazole with secondary coconut $C_{12-18}$ amines and formaldehyde, salicylaminoguanidine monooleate, and mixtures thereof. A commercially-available source of salicylaminoguanidine monooleate is "Ortholeum 300", which contains about 10% of salicylalaminoguanidine monooleate and 90% of diphenylamine. Suitable lead passivators include alkyl gallates such as propyl and lauryl gallates; phenothiazine and substitutes phenothiazoles; quinizarin, alizarin; dicarboxylic acids such as sebacic, azelaic, and adipic acids and esters of these acids such as neopentyl glycol sebacate and 2-ethylhexyl azelate. The peferred lead passivator is phenothiazine. The grease compositions may also contain additives that inhibit the corrosion of engine components that contain silver, magnesium, and other metals.

The useful load-bearing additives, which function as oiliness agents, anti-wear and anti-scuff agents, and extremepressure agents, are organic compounds that contain phosphorus, sulfur, and/or chlorine. They include Group II metal dialkyl, diaryl, and dicycloalkyl dithiophosphates, Group II metal dialkyl, diaryl, and dicycloalkyl thiocarbamates, alkyl mercaptothiazdiazole, aryl phosphate esters, amine salts of partially-esterified phosphoric and chlorophosphoric acids, aryl thiophosphate esters, polyphosphites, chlorinated diphenyls, and mixtures thereof. Illstrative of these load-bearing agents are zinc diamyl dithiophosphate, zinc diphenyl dithiophosphate, zinc dicyclohexyl dithiophosphate, cadmium dihexyl thiocarbamate, butyl mercaptothiadiazole, tricresyl phosphate, triphenyl thiophosphate, amine salts of diethyl phosphate, and amine salts of diphenyl chlorophosphonate. The preferred load-bearing additives are polyphosphites. Among the useful polyphosphites are those disclosed in U.S. Pat. No. 3,375,304, which is incorporated herein by reference. These polyphosphites have the structural formula

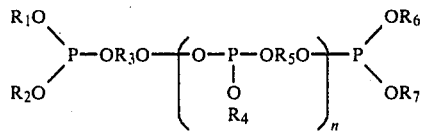

wherein $R_1$, $R_2$, $R_4$, $R_6$, and $R_7$ are phenyl, alkylphenyl having 1 to 18 carbon atoms in the alkyl group, chlorophenyl, or bromophenyl; $R_3$ and $R_5$ are polyalkylene glycol, alkylidene bisphenol, hydrogenated alkylidene bisphenol, or ring-halogenated alkylidene bisphenol from which the two terminal hydrogens have been removed; and n is an integer in the range of 1 to 18. The preferred load-bearing additive is the polyphosphite having the aforementioned structural formula that is marketed as Weston DHOP. Other polyphosphites that can be used in the greases of this invention include those disclosed in U.S. Pat. No. 3,558,539, which have the structural formula

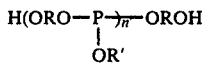

wherein R is the divalent residue of hydrogenated 4,4-isopropylidene diphenol, R' is an aryl group having 6 to 10 carbon atoms or an alkyl group having 1 to 20 carbon atoms, and n' is an integer in the range of 2 to 5, and the polyphosphite disclosed in U.S. Pat. No. 3,737,485, which has the structural formula

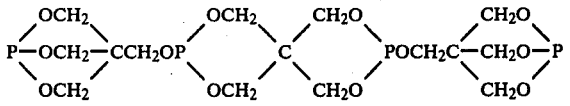

From the foregoing descriptions of the components of the additive systems, it will be seen that there are compounds that have properties that make them useful in more than one of the components of the additive systems. For example, phenothiazine serves both as an antioxidant and as a lead passivator in the novel grease compositions.

The additives may be added individually to the base fluid, or a pre-blended additive system may be added to it.

The solutions of the additive systems in the base fluids are converted to high temperature grease compositions by blending them with a grease-forming quantity of a thickener component that comprises an organophilic surface-modified clay.

The organophilic surface-modified clays that are used as the thickening agents in the grease compositions of this invention are prepared from clays which initially are hydrophilic in character, but which have been converted to an organophilic condition by the introduction of long chain hydrocarbon radicals into the surface of the clay particles. This can be done, for example, by treating the clays with an organic cationic surface-active agent that is preferably an organic ammonium chloride, e.g., dimethyldioctadecyl ammonium chloride, dimethyldibenzyl ammonium chloride, dimethylbenzyloctadecyl ammonium chloride, and mixtures thereof.

Hydrophilic clays that can be converted in this way to organophilic surface-modified clays that are effective as thickening agents for the high temperature grease compositions of this invention include montmorillonite clays, such as bentonite, attapulgite, hectorite, vermiculite, and the like. The preferred organophilic clay thickening agents are dimethyldioctadecyl ammonium bentonite, dimethylbenzyloctadecyl ammonium bentonite, and mixtures thereof. If desired, such other conventional thickening agents as polyureas, silica gel, and carbon black can be used in combination with the organophilic surface-modified clays as the thickening agent in the high temperature greases of this invention.

In addition to the organophilic surface-modified clay, the thickener component of the high temperature greases contains a dispersant that may be a $C_{2-6}$ alkylene glycol, a fatty acids ester of a $C_{2-6}$ alkylene glycol, a carbonate of a $C_{2-6}$ alkylene glycol or a lower aliphatic ketone. Suitable dispersants include propylene glycol, hexylene glycol, ethylene glycol dioleate, butylene glycol dioctanoate, propylene carbonate, butylene carbonate, hexylene carbonate, and acetone.

The thickener component usually contains 95% to 99% by weight of the organophilic surface-modified clay and 1% to 5% by weight of dispersant; it preferably contains 97% to 98% by weight of clay and 2% to 3% by weight of dispersant.

The invention is further illustrated by the following examples. In these examples, all parts are parts by weight, and all percentages are percentages by weight.

EXAMPLE 1

A grease composition was prepared using as the base fluid the diisodecyl ester of hydrogenated $C_{36}$ dimer acids that contained 1% of monoacids, 95% of dimer acids, and 4% of trimer acids (Hystrene 3695 Hydrogenated).

To 253.05 parts of the diisodecyl hydrogenated dimerate was added an additive system that consisted of 2.0 parts of sorbitan monooleate, 1.0 part of phenothiazine, 1.0 part of phenyl-alpha-naphthylamine, 0.5 part of a mixture of 10% of 1-salicylalaminoguanidine monooleate and 90% of diphenylamine (Ortholeum 300), 0.5 part of p,p'-dioctyldiphenylamine, 0.3 part of a polyphosphite (Weston DHOP), and 0.05 part of a benzotriazole reaction product with a secondary coconut $C_{12-18}$ amine and formaldehyde (Reomet 38).

The base fluid and additive system were stirred and heated at 102° C. until complete dissolution had occurred and a homogeneous solution was obtained. To the hot solution were added 28.5 parts of dimethylbenzyloctadecyl ammonium bentonite (Baragel 24) and 0.8 part of propylene carbonate.

The resulting thick slurry was stirred until gelation was complete. After it had been milled on a three-roll mill, the grease had the following properties as determined by standard test methods:

| | | |
|---|---|---|
| Worked Penetration | (ASTM D 217) | 280 |
| Worked Stability After 100,000 Strokes | (ASTM D 217) | 320 |
| Dropping Point | (ASTM D 566) | >274° C. |
| Oil separation after 30 hours at 204° C. | | 2.5% |

In an oven stability test, the grease had lost 13% of its weight after 20 hours and 19% after 40 hours at 232° C.

EXAMPLE 2

Using the procedure described in Example 1, a grease composition was prepared in which the base fluid was the di(tridecyl) ester of hydrogenated $C_{36}$ dimer acids that contained 1% of monoacids, 95% of dimer acids, and 4% of trimer acids (Hystrene 3695 Hydrogenated). The additive system and thickener component used were the same as those used in Example 1. This grease had a worked penetration of 322, as determined by ASTM D 217.

EXAMPLE 3

The products of Examples 1 and 2 and a comparative grease in which the base fluid was di(tridecyl)adipate and the additive system and thickener component were those used in Example 1 were evaluated in the U.S. Steel Static Heat Test, which measures changes in penetration with time at 177° C. In this test, the penetration of a grease is determined by measuring the depth in millimeters that a steel cone dropped from a uniform height penetrates the surface of the grease. The results obtained are set forth in Table I.

From the data in Table I, it will be seen that the greases of this invention were softer and less volatile than the comparative grease.

TABLE I

| Ex. No. | Grease | Base Fluid | Penetration, After Indicated Number of Hours at 177° C. 0 | 150 | 300 | % Weight Loss After 150 Hours at 177° C. |
|---|---|---|---|---|---|---|
| 3A | Prod. of Ex. 1 | Diisodecyl Hyd. Dimerate | 275 | 103 | 77 | 8 |
| 3B | Prod. of Ex. 2 | Di(tridecyl) Hyd. Dimerate | 272 | 105 | 62 | 7 |
| Comp. Ex. 1 | Comparative Grease | Di(tridecyl) Adipate | 237 | 73 | Solid | 39 |

EXAMPLE 4

Using the procedure described in Example 1, a series of greases that contained various base fluids was prepared. In each case, the additive system and thickener component were those used in Example 1.

The following base fluids were used in the preparation of the greases:

A. Diidodecyl ester of hydrogenated $C_{36}$ dimer acids that contained 1% monoacids, 95% dimer acids, and 4% trimer acids.

B. Diisodecyl ester of hydrogenated $C_{36}$ dimer acids that contained 97% dimer acids and 3% trimer acids.

C. Diisodecyl ester of hydrogenated $C_{36}$ dimer acids that contained 95% dimer acids and 5% trimer acids.

D. Di(tridecyl)sebacate

E. Di(tridecyl)adipate

F. Polyester

The data in Table II show that the greases of this invention that contained base fluids A-C were substantially more stable at both 232° C. annd 246° C. than the comparative greases that contained base fluids D-F.

The heat stabilities of the greases were determined by measuring their loss in weight on being heated at elevated temperatures in an over for long periods of time.

The length of the heat stability tests, the temperatures at which they were carried out, and the results obtained are given in Table II

TABLE II

| Ex. No. | Base Fluid | Time (Hours) | Temp. (°C.) | % Weight Loss |
|---|---|---|---|---|
| 4A | A | 16 | 232 | 8 |
| 4B | A | 20 | 232 | 13 |
| 4C | A | 40 | 232 | 19 |
| 4D | A | 16 | 246 | 22 |
| 4E | B | 16 | 232 | 11 |
| 4F | C | 16 | 232 | 19 |
| Comp. Ex. 2 | D | 16 | 232 | 48 |
| Comp. Ex. 3 | D | 16 | 246 | 83 |
| Comp. Ex. 4 | E | 16 | 232 | 83 |
| Comp. Ex. 5 | F | 16 | 232 | 23 |
| Comp. Ex. 6 | F | 16 | 246 | 75 |

What is claimed is:

1. A high temperature grease composition that comprises (a) 80% to 94% of a base fluid that is a dialkyl ester of hydrogenated dimer acids having 32 to 52 carbon atoms and containing less than 8% based on the weight of dimer acids of trimer acids, wherein each alkyl group has 5 to 16 carbon atoms;

(b) 0.2% to 6% of an additive system that comprises (i) 0.1% to 2% of an antioxidant component that comprises an aromatic amine selected from the group consisting of secondary amines having the structural formula

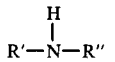

wherein R′ and R″ each represents phenyl, alkylphenyl, naphthyl, or alkylnaphthyl; phenothiazine; alkylphenothiazines; alkoxyphenothiazines; alkyl-hydroxybenzylcarbazoles; and mixtures thereof;

(ii) 0.08% to 2% of a rust-inhibiting component selected from the group consisting of Group II metal salts, ammonium salts, and amine salts of petroleum sulfonic acids, alkylated naphthalene sulfonic acids, alkenylsuccinic acids, and sorbitan esters of $C_{10-18}$ fatty acids;

(iii) 0.01% to 1% of a metal-passivating component selected from the group consisting of benzimidazole, benzotriazole, alkylbenzotriazoles, aminobenzotriazoles, methylene bis benzotriazole, the reaction product of benzotriazole with $C_{12-18}$ secondary amines and formaldehyde, phenothiazine, naphthotriazole, salicylaldehyde semicarbazone, alkylsalicylaldehyde semicarbazones, $C_{12-18}$ fatty acid salts of salicylalaminoguanidine, and mixtures thereof; and (iv) 0.01% to 1% of a load-bearing component selected from the group consisting of Group II metal diorgano dithiophosphates and thiocarbamates, amine salts of partially-esterified phosphoric and chlorophosphonic acids, alkyl mercaptothiadiazoles, aryl phosphates and thiophosphates, chlorinated diphenyls, polyphosphites, and mixtures thereof; and (c) 5% to 20% of a thickener component that contains 4.7% to 19.8% of an oleophilic surface-modified clay and 0.2% to 1% of a dispersant selected from the group consisting of $C_{2-6}$ alkylene glycols, fatty acids esters of said glycols, carbonates of said glycols, and lower alkyl ketones, all percentages being percentages by weight based on the weight of the grease composition unless otherwise specified.

2. A grease composition as defined in claim 1 wherein the base fluid is the diisodecyl ester of hydrogenated $C_{36}$ dimer acids that contain less than 5% by weight of trimer acids.

3. A grease composition as defined in claim 1 wherein the base fluid is the di(tridecyl) ester of hydrogenated $C_{36}$ dimer acids that contain less than 5% by weight of trimer acids.

4. A grease composition as defined in claim 1 wherein the antioxidant component comprises phenyl-alpha-naphthylamine, phenothiazine, and p,p′-dioctyldiphenylamine.

5. A grease composition as defined in claim 1 wherein the rust-inhibiting component is sorbitan monooleate.

6. A grease composition as defined in claim 1 wherein the metal-passivating component comprises salicylalaminoguanidine monooleate.

7. A grease composition as defined in claim 1 wherein the metal-passivating component comprises salicylalaminoguanidine monooleate and the reaction product of benzotriazole with a secondary coconut $C_{12-18}$ amine and formaldehyde.

8. A grease composition as defined in claim 1 wherein the load-bearing component is a polyphosphite having the structural formula

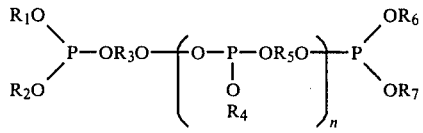

wherein $R_1$, $R_2$, $R_4$, $R_6$, and $R_7$ each represents phenyl, alkylphenyl having 1 to 18 carbon atoms in the alkyl group, chlorophenyl or bromophenyl; $R_3$ and $R_5$ each represents a polyalkylene glycol, an alkylidene bisphenol, a hydrogenated alkylidene bisphenol, or a ring-halogenated alkylidene bisphenol residue from which the two terminal hydrogens have been removed; and n is an integer in the range of 1 to 18.

9. A grease composition as defined in claim 1 wherein the oleophilic surface-modified clay is dimethylbenzyloctadecyl ammonium bentonite.

10. A grease composition as defined in claim 1 wherein the dispersant is propylene carbonate.

11. A grease composition as defined in claim 1 that comprises (a) 85% to 90% of a dialkyl ester of hydrogenated dimer acids having 36 carbon atoms and containing less than 5%, based on the weight of dimer acids, of trimer acids, wherein each alkyl group has 10 to 13 carbon atoms;

(b) 0.7% to 4% of an additive system that comprises (i) 0.5% to 1.5% of said antioxidant component, (ii) 0.1% to 1.0% of said rust-inhibiting component, (iii) 0.02% to 0.5% of said metal-passivating component, and (iv) 0.05% to 0.5% of said load-bearing component; and (c) 8% to 12% of a thickener component that contains 7.5% to 11.3% of an oleophilic surface-modified clay and 0.2% to 0.7% of said dispersant, all percentages being percentages by weight based on the weight of the grease composition unless otherwise specified.

12. A grease composition as defined in claim 11 that comprises (a) 85% to 90% of the diisodecyl ester of hydrogenated $C_{36}$ dimer acids that contain less than 5%, based on the weight of dimer acids, of trimer acids;

(b) 0.7% to 4% of an additive system that comprises (i) 0.5% to 1.5% of an antioxidant component that comprises phenyl-alpha-naphthylamine, phenothiazine, diphenylamine, and p,p'-dioctyldiphenylamine, (ii) 0.1% to 1.0% of sorbitan monooleate, (iii) 0.02% to 0.5% of a metal-passivating component that comprises salicylalaminoguanidine monooleate and the reaction product of benzotriazole with a secondary coconut $C_{12-18}$ amine and formaldehyde, and (iv) 0.05% to 0.5% of a polyphosphite; and (c) 8% to 12% of a thickener component that contains 7.5% to 11.3% of dimethylbenzyloctadecyl ammonium bentonite and 0.2% to 0.7% of propylene carbonate, all percentages being percentages by weight based on the weight of the grease composition unless otherwise specified.

* * * * *

UNITED STATES PATENT AND TRADEMARK OFFICE

CERTIFICATE OF CORRECTION

PATENT NO. : 4,298,481

DATED : Nov. 3, 1981

INVENTOR(S) : David B. Clarke

It is certified that error appears in the above-identified patent and that said Letters Patent are hereby corrected as shown below:

Column 1, line 6, change "prolonger" to -- prolonged --;

Column 1, line 50, after "system" change "and" to -- as --;

Column 2, line 10, change "tradkmark" to -- trademark --;

Column 2, line 60, change "alylnaphthyl" to -- alkylnaphthyl --;

Column 3, line 10, insert a comma (,) after "acids";

Column 3, line 11, change "ates" to -- ated --;

Column 3, line 26, change "napthotriazole" to -- naphthotriazole --;

Column 3, line 46, change "peferred" to -- preferred --;

Column 3, line 60, change "Illstrative" to -- Illustrative --;

Column 6, line 68, change "over" to -- oven --.

Signed and Sealed this

*Nineteenth* Day of *January 1982*

[SEAL]

*Attest:*

GERALD J. MOSSINGHOFF

*Attesting Officer*

*Commissioner of Patents and Trademarks*